US008691483B2

(12) United States Patent
Yasutomi

(10) Patent No.: US 8,691,483 B2
(45) Date of Patent: Apr. 8, 2014

(54) TONER FOR DEVELOPING ELECTROSTATIC CHARGE IMAGE

(75) Inventor: Shiro Yasutomi, Joetsu (JP)

(73) Assignee: Mitsubishi Chemical Corporation, Tokyo (JP)

( * ) Notice: Subject to any disclaimer, the term of this patent is extended or adjusted under 35 U.S.C. 154(b) by 0 days.

(21) Appl. No.: 13/115,571

(22) Filed: May 25, 2011

(65) Prior Publication Data

US 2011/0294060 A1 Dec. 1, 2011

(30) Foreign Application Priority Data

May 26, 2010 (JP) ..... 2010-120683

(51) Int. Cl.
*G03G 9/097* (2006.01)

(52) U.S. Cl.
USPC ..... 430/108.7; 430/108.1; 430/108.24; 430/108.3; 430/108.6

(58) Field of Classification Search
USPC ..... 430/108.1, 108.24, 108.3, 108.6, 108.7
See application file for complete search history.

(56) References Cited

U.S. PATENT DOCUMENTS 4,845,004 A * 7/1989 Kobayashi ..... 430/108.24
5,707,770 A * 1/1998 Tanikawa et al. ..... 430/108.6
2002/0061457 A1 5/2002 Okuno et al.
2002/0115008 A1 8/2002 Suzuki et al.
2003/0017406 A1* 1/2003 Gutman et al. ..... 430/108.3
2008/0247788 A1* 10/2008 Ayaki et al. ..... 399/321
2009/0117485 A1* 5/2009 Kimura et al. ..... 430/109.4
2010/0009278 A1* 1/2010 Ikeda et al. ..... 430/108.7

FOREIGN PATENT DOCUMENTS

JP 2001-66820 3/2001
JP 2001-109185 4/2001
JP 2002-108001 4/2002
JP 2008-58395 3/2008

* cited by examiner

*Primary Examiner* — Peter Vajda
(74) *Attorney, Agent, or Firm* — Oblon, Spivak, McClelland, Maier & Neustadt, L.L.P.

(57) ABSTRACT

To provide a toner for developing an electrostatic charge image, which is free from fogging even by means of a high speed and long operating life machine and which brings about no OPC filming or soiling of components.

A toner for developing an electrostatic charge image, which contains at least a binder resin and a colorant, wherein the toner has silica particles satisfying at least the following (1) to (3) and particles having an electrostatic property antipolar to the silica particles:

(1) the average primary particle diameter is at least 60 nm and at most 300 nm, (2) the moisture content is at most 1.0 mass %, and (3) the absolute specific gravity is at least 2.0 and at most 2.4.

12 Claims, No Drawings

TONER FOR DEVELOPING ELECTROSTATIC CHARGE IMAGE

BACKGROUND OF INVENTION

1. Field of Invention

The present invention relates to a toner for developing an electrostatic charge image.

2. Discussion of Background

An electrophotographic method usually has steps of forming an electrostatic latent image on a photoconductive photoreceptor by various methods, then visualizing the latent image by means of a toner for developing an electrostatic charge image (hereinafter simply referred to as a "toner"), thereafter transferring the image visualized by the toner to a transfer material such as transfer paper, and fixing the toner image by e.g. heating or pressing. Various methods are known for such steps, and those suitable for the respective processes for forming images are employed.

A pulverization method may be mentioned as one of typical methods for producing toners. This is a method wherein raw materials such as a binder resin, a colorant, a release agent, an electrostatic charge controlling agent, etc. are melt-kneaded, pulverized and classified to obtain toner particles, and it has been widely employed, since it is relatively inexpensive and simple.

In recent years, research and development have been active on a polymerized toner to be produced by a polymerization method such as a suspension polymerization, an emulsion polymerization/coagulation method or a dissolution/suspension method in order to accomplish size reduction or narrower particle size distribution of the toner thereby to accomplish high image quality. With the polymerized toner, the size reduction is relatively easy as compared with the pulverized toner, and a sharp particle size distribution is readily obtainable. Further, the matrix particles may be capsulated, whereby there is a merit such that a toner having heat resistance or low temperature fixing properties can be obtained.

However, the demand for high image quality in the electrophotographic market is particularly strong with respect to a full color image, and various studies are being made to accomplish, in addition to the above-mentioned size reduction of the toner, high durability and control of electrostatic charge/flowability to constantly obtain a high quality.

In order to increase the durability of the toner, a technique of adding spherical silica having a submicron size is known. By this technique, spherical silica present on the outermost surface of the toner particles exhibits a spacer effect, whereby it becomes possible to prevent filming on the photoconductor drum which is problematic during development or to prevent embedding the small size additive in the toner matrix particles. Further, this technique is also effective to improve the transfer efficiency by reducing the adhesion of the toner to the components.

As such spherical silica, silica prepared by a wet method is employed (Patent Documents 1 and 2), but such silica contains a large amount of moisture from its preparation method, whereby the electrostatic property of itself is low, and the electrostatic charge of the toner having such silica added also tends to be low. Accordingly, the toner having such spherical silica added exhibits a certain effect for e.g. improvement of the transfer efficiency or prevention of the OPC (organic photoconductors, hereinafter referred to as "OPC") filming, but it tends to bring about fogging from the initial stage because of the low electrostatic charge. Such a problem is particularly distinct when printing is carried out under a severer fogging condition i.e. in a high temperature and high humidity environment or by a nonmagnetic one component development system, particularly by means of a high speed machine with a process rate of at least 160 mm/sec. By the technique disclosed in the above documents only, it is not possible to provide an adequate performance to avoid fogging in addition to the OPC filming, etc.

There is a case wherein silica prepared by a dry method is used (Patent Document 3). However, silica prepared by such a conventional method had a small primary particle diameter, whereby the spacer effects were insufficient.

On the other hand, as a means to solve the fogging, a method of adding a large particle diameter additive having an electrostatic property antipolar to the toner, is known. For example, to a negatively chargeable toner, melamine resin particles, etc. may be added. That is, strongly positively chargeable melamine resin particles are attached to or detached from the toner, whereby the toner tends to readily obtain strong and uniform negative chargeability and fogging will be reduced, and there is a further merit such that the electrostatic charge distribution becomes uniform, whereby the uniformity of a solid or half-tone image will be increased.

However, the detached oppositely-charged particles are likely to soil components such as OPC and an electrostatically charged roller, and it is necessary to pay attention to the particle diameter of oppositely-charged particles, adding conditions, etc. Especially when an additive having the same polarity as the toner is used in combination, if its adhesion is weak, it may be peeled off form the toner matrix particles in such a form as surrounded by the oppositely-charged particles and thus tends to increase the soiling of components.

By a study in the present invention, it has been made clear that in a case where such oppositely-charged particles are used in combination with the spherical silica disclosed in the above documents, although the intended improvement to overcome fogging is observed, the electrostatic charges are mutually antipolar, and both of them have readily detachable particle diameters, whereby soiling of components is synergistically increased.

That is, no technique capable of solving the above problems comprehensively has been available.

Patent Document 1: US2002/0115008 A1

Patent Document 2: US2002/0061457 A1

Patent Document 3: JP-A-2001-109185

SUMMARY OF INVENTION

The present invention has been made in view such background art, and it is an object of the present invention to provide a toner for developing an electrostatic charge image, which is free from fogging even by means of a high speed and long operating life machine and which brings about no OPC filming or soiling of components.

The present inventor has conducted an extensive study to solve the above problems and have found it possible to solve the problems by using silica having physical properties within specific ranges and particles having an electrostatic property antipolar to the silica particles, in combination. The present invention is based on such a discovery and provides the following.

1. A toner for developing an electrostatic charge image, which contains at least a binder resin and a colorant, wherein the toner has silica particles satisfying at least the following (1) to (3) and particles having an electrostatic property antipolar to the silica particles:

(1) the average primary particle diameter is at least 60 nm and at most 300 nm, (2) the moisture content is at most 4-1.0 mass %, and (3) the absolute specific gravity is at least 2.0 and at most 2.4.

2. The toner for developing an electrostatic charge image according to the above 1, wherein the silica particles are prepared by a dry method.

3. The toner for developing an electrostatic charge image according to the above 1 or 2, wherein the particles having an electrostatic property antipolar to the silica particles are melamine resin particles, acrylic resin particles or silica particles.

4. The toner for developing an electrostatic charge image according to any one of the above 1 to 3, wherein the silica particles have their surface subjected to hydrophobic treatment.

5. The toner for developing an electrostatic charge image according to any one of the above 1 to 4, wherein the particles having an electrostatic property antipolar to the silica particles have an average primary particle diameter of at least 80 nm and at most 300 nm.

6. The toner for developing an electrostatic charge image according to any one of the above 1 to 5, wherein the silica particles and the particles having an electrostatic property antipolar to the silica particles, are attached or fixed to the surface of toner matrix particles.

7. The toner for developing an electrostatic charge image according to any one of the above 1 to 6, wherein the toner further contains wax.

8. The toner for developing an electrostatic charge image according to any one of the above 1 to 7, wherein the toner is produced by a pulverization method or a wet method.

9. The toner for developing an electrostatic charge image according to any one of the above 1 to 8, wherein the toner has a volume median diameter of from 4 to 8 μm and an average circularity of from 0.955 to 0.985.

10. An image-forming method by means of an electrophotographic method provided at least with a photoreceptor, a toner, an electrification device and a transfer device, characterized in that the toner for developing an electrostatic charge image as defined in any one of the above 1 to 9 is used for a nonmagnetic one-component development method.

11. The image-forming method according to the above 10, wherein the development rate is at least 100 mm/sec.

DETAILED DESCRIPTION OF PREFERRED EMBODIMENTS

The silica particles to be used in the present invention are usually ones which are electrostatically charged to have the same polarity as the entire toner. Such silica particles are used typically as an additive to the toner in such a state as attached or fixed to the toner surface. The average primary particle diameter of the silica particles is at least 60 nm and at most 300 nm. It is preferably at least 70 nm, particularly preferably at least 75 nm. Further, it is preferably at most 250 nm, particularly preferably at most 150 nm. If the average primary particle diameter is too small, no adequate spacer effect tends to be obtainable, whereby formation of OPC filming or embedding of the small size additive in the toner matrix particles is likely to be brought about, and there may be a case where fogging, blurring or the like occurs after the printing. On the other hand, if it is too large, the silica particles are likely to be hardly attached to the toner matrix particles, and there may be a case where soiling of components occurs due to their detachment. The average primary particle diameter is measured by the method disclosed in Examples.

In the silica particles to be used in the present invention, the moisture content is required to be at most 1.0 mass %. It is preferably at most 0.8 mass %, particularly preferably at most 0.5 mass %. If the moisture content is too high, the electrostatic charge of the silica itself tends to be low due to the excess moisture content, and the electrostatic charge of the toner having such silica added also tends to be low, whereby fogging is likely to result. Such a problem is particularly distinct during printing under a severer fogging condition, such as in a high temperature and high humidity environment or by a nonmagnetic one component development system, particularly by a high speed machine having a process rate of at least 160 nm/sec. Further, as the electrostatic charge of the silica particles themselves tends to be low, the electrostatic adhesion to the toner matrix particles tends to be low, and there may be a case where by the particles having an electric charge antipolar to the silica particles, they tend to be more easily peeled from the toner matrix particles. Further, if the silica particles contain adsorbed water, the affinity to the particles having an electric charge antipolar to the silica particles will increase, and the physical adhesion thereto becomes strong, whereby there may be a case where peeling is more likely to take place. The moisture content is measured by the method disclosed in Examples.

Of the silica particles to be used in the present invention, the absolute specific gravity is required to be at least 2.0 and at most 2.4. It is preferably at least 2.1. Further, it is preferably at most 2.35, particularly preferably at most 2.30. If the absolute specific gravity is too small, the silica tends to readily adsorb moisture on its surface, whereby the electrostatic charge is likely to be low particularly in a high temperature and high humidity environment, and there may be a case where fogging occurs. On the other hand, if it is too large, it tends to be difficult to uniformly disperse them in the toner, whereby image blurring is likely to result due to deterioration of the electrostatic charge distribution, or there may be a case where soiling of components results due to their detachment from the toner surface. The absolute specific gravity is measured by the method disclosed in Examples.

The silica particles may, for example, be porous or particles having no internal surface area. Silica particles having no internal surface area are preferred, since the value of the absolute specific gravity of the present invention is thereby easily met. Further, silica particles satisfying the absolute specific gravity of the present invention may be obtainable also by preparing silica particles by a wet method including no firing step. However, if the moisture content is too high, the electrostatic charge of the silica itself tends to be low due to the excessive moisture, whereby the electrostatic charge of the toner having such silica added also tends to be low, and there may be a case where fogging results.

Further, even when the moisture content of silica particles is at most 1.0 mass % under a normal temperature and humidity condition, silica particles having a low absolute specific gravity and an internal surface area, tend to absorb moisture in a high temperature and high humidity environment, and in such an environment, the electrostatic charge of the silica particles themselves is likely to be low also by the excessive moisture, and a change in the electrostatic charge of the toner is induced by the environment, whereby there may be a case where a problem of fogging in a high temperature and high humidity environment or a problem of an image soiling due to a charge up in a low temperature and humidity environment, will result.

The amount of silica particles to be used in the present invention is preferably at least 0.5 part by mass, more preferably at least 0.8 part by mass, particularly preferably at least 1.0 part by mass, per 100 parts by mass of the toner matrix particles. Further, it is preferably at most 3.5 parts by mass, more preferably at most 3.0 parts by mass, particularly preferably at most 2.5 parts by mass. If the amount is too small, the spacer effect cannot sufficiently be obtained, and there may be a case where OPC filming will result, or embedding of the small size additive is likely to occur, thus leading to fogging or blurring after the printing. On the other hand, if it is too large, a part of excessive silica particles may not attach to the toner matrix particles and may remain as being free to cause soiling of components, or agglomerated silica particles are likely to attach to the toner matrix particles, thus again leading to soiling of components.

The method for producing silica particles to be used in the present invention is not particularly limited, and the silica particles may be prepared by a known method. However, ones produced by a dry method are preferred, since the moisture content and the absolute specific gravity can thereby be readily adjusted to be within the ranges defined by the present invention. Here, the dry method means a production method by a reaction in a gas phase in general, such as flame hydrolysis of a silicon compound, oxidation by a flame burning method, or a method by a combination of these reactions.

The silica particles to be used in the present invention preferably have their surface subjected to hydrophobic treatment, from the viewpoint of an environmental stability. The treating agent and treating method are not particularly limited and may, respectively, be conventional ones. A preferred treating agent may, for example, be hexamethyldisilazane, polydimethylsiloxane, dimethyldichlorosilane or methyltriethoxysilane. Hexamethyldisilazane or polydimethylsiloxane is preferred, and polydimethylsiloxane is particularly preferred since a higher hydrophobicity can thereby be imparted.

The toner of the present invention is required to have, together with the above silica particles, particles having an antistatic property antipolar to the silica particles. As the particles having an antipolar electrostatic property are attached to and detached from the toner matrix particles, the electrostatic charge of the toner tends to be high and uniform and will be stabilized even under a high temperature and high humidity environment. The electrostatic polarity and the electrostatic charge are measured by the methods disclosed in Examples.

The type of the particles having an electrostatic property antipolar to the silica particles is not particularly limited. However, particularly in a case where the silica particles are negatively charged, it is preferred to employ melamine resin particles from the viewpoint of the electrostatic characteristics. Otherwise, a positively chargeable acrylic resin may also be used. Further, in a case where the silica particles are positively charged, it is also possible to use negatively chargeable silica particles.

The above melamine resin may, for example, be, in addition to a so-called melamine/formaldehyde condensed resin, a melamine/urea/formaldehyde co-condensed resin or a melamine/benzoguanamine/formaldehyde co-condensed resin, so long as melamine is used as the main component. Among them, a melamine/formaldehyde condensed resin is particularly preferred in the present invention.

The average primary particle diameter of the particles having an electrostatic property antipolar to the silica particles, is preferably at least 80 nm, more preferably at least 120 nm, particularly preferably at least 150 nm. Further, it is preferably at most 300 nm, more preferably at most 270 nm, particularly preferably at most 250 nm. If the average primary particle diameter is too small, the adhesion to the toner matrix particles tends to be too strong, and there may be a case where the expected improvement of the electrostatic charge cannot be obtained, and fogging is likely to result. On the other hand, if it is too large, the particles having an electrostatic property antipolar to the silica particles, themselves, tend to be detached from the toner matrix particles and may cause soiling of components.

The amount of the particles having an electrostatic property antipolar to the silica particles is preferably at most 0.5 part by mass, more preferably at most 0.4 part by mass, particularly preferably at most 0.3 part by mass, per 100 parts by mass of the toner matrix particles. On the other hand, it is preferably at least 0.05 part by mass, particularly preferably at least 0.10 part by mass. If the amount is too small, the expected improvement of the electrostatic charge cannot be obtained, and fogging is likely to result. On the other hand, if the amount is too large, the excessive antipolar electrostatic particles rather tend to lower the electrostatic charge of the toner, whereby fogging may result.

The method for producing the toner of the present invention is not particularly limited, and the toner contains at least a binder resin and a colorant and may contain an electrification-controlling agent, wax and other additives, as the case requires.

In the present invention, as the binder resin to be contained in the toner, a resin which is commonly used as a binder resin for conventional toners may suitably be used. For example, as a monomer, it is possible to use any polymerizable monomer selected from a polymerizable monomer having an acidic group (hereinafter sometimes referred to simply as an acidic monomer), a polymerizable monomer having a basic group (hereinafter sometimes referred to simply as a basic monomer) and a polymerizable monomer having no acidic or basic group (hereinafter sometimes referred to as another monomer).

The method for producing the toner of the present invention is not limited, and a conventional method may be used such as a pulverization method, a wet method or a method of spheroidizing the toner by e.g. thermal treatment or mechanical impact force. The wet method may, for example, be a method such as a suspension polymerization method, an emulsion polymerization coagulation method, a solution suspension method or an ester-extension method.

The pulverization method will be described. In the case of the pulverization method, the binder resin, the colorant and, as the case requires, other components are weighed in prescribed amounts, blended and mixed. The mixing apparatus may, for example, be a double cone mixer, a V-type mixer, a drum-type mixer, a super mixer, a Henschel mixer or a nautor mixer.

Then, the above blended and mixed toner raw material is melt-kneaded to melt the resin and to disperse the colorant, etc. therein. In such a melt-kneading step, it is possible to employ a batch-type kneader such as a pressure kneader or a Banbury mixer, or a continuous type kneader. As a kneader, a single screw or double screw extruder may be employed. For example, a KTK-type twin screw extruder manufactured by Kobe Steel, Ltd., a TEM-type twin screw extruder manufactured by Toshiba Machine Co., Ltd., a twin screw extruder manufactured by KCK or a co-kneader manufactured by Buss may, for example, be mentioned. Further, a colored resin composition obtainable by melt-kneading the toner raw material is rolled by a twin roll mill after the melt kneading and then cooled via a cooling step of cooling by e.g. water cooling.

The cooled product of the colored resin composition obtained as described above, is then pulverized to a desired particle diameter in a pulverization step. In the pulverization step, the cooled product is firstly roughly pulverized by a crusher, a hammer mill or a feather mill and further pulverized by e.g. a criptron system manufactured by Kawasaki Heavy Industries, Ltd. or a super rotor manufactured by Nisshin Engineering Inc. Thereafter, as the case requires, the pulverized product is classified by means of a sieving machine such as a classification machine, such as an inertial classification system elbow jet (manufactured by Nittetsu Mining Co., Ltd.) or a turboflex of a centrifugal classification system (manufactured by Hosokawa Micron Corporation), to obtain toner matrix particles. Further, the toner may be spheronized by a conventional method.

The wet method may, for example, be a suspension polymerization method, an emulsion polymerization coagulation method or a dissolution suspension method, and the production may be carried out by any method without any particular restriction.

In the present invention, in the method for producing a suspension polymerization toner, a colorant, a polymerization initiator and, as the case requires, additives such as wax, a polar resin, an electrification-controlling agent, a crosslinking agent, etc., are added in the monomer for the binder resin, and uniformly dissolved or dispersed to prepare a monomer composition. Such a monomer composition is dispersed in an aqueous medium containing a dispersion stabilizer, etc. Preferably, the stirring speed and time are adjusted for granulation so that liquid droplets of the monomer composition have a desired size of toner particles. Thereafter, polymerization is carried out by carrying out stirring to such an extent that the particle state is maintained by the action of the dispersion stabilizer and the precipitation of particles is prevented. These particles are collected by washing and filtration, followed by drying to obtain toner matrix particles.

Whereas, in the production method by an emulsion polymerization coagulation method, primary particles of polymers obtained by emulsion polymerization of binder resin monomers in an emulsion polymerization step, a colorant dispersion, a wax dispersion, etc. are preliminarily prepared, and they are dispersed in an aqueous medium, followed by heating, etc. to carry out a coagulation step and further an aging step. Agglomerated particles thus aged are washed and collected by filtration and dried to obtain toner matrix particles. Further, as the case requires, additives may be added to obtain a toner.

The emulsion polymerization coagulation method will be described in further detail. In the emulsion polymerization step, polymerizable monomers are polymerized in an aqueous medium usually in the presence of an emulsifier. In such a case, when polymerizable monomers are supplied to the reaction system, the respective monomers may be separately added, or a plurality of monomers may preliminarily be mixed and simultaneously added. Further, the monomers may be added as they are, or may be added in the form of an emulsion as preliminarily mixed and adjusted with water, an emulsifier, etc.

An acidic monomer may, for example, be a polymerizable monomer having a carboxy group such as acrylic acid, methacrylic acid, maleic acid, fumaric acid or cinnamic acid, a polymerizable monomer having a sulfonate group such as styrene sulfonate, or a polymerizable monomer having a sulfonamide group such as vinylbenzenesulfonamide. Whereas, a basic monomer may, for example, be an aromatic vinyl compound having an amino group, such as aminostyrene, a nitrogen-containing hetero ring-containing polymerizable monomer such as vinylpyridine or vinylpyrrolidone, or a (meth)acrylic acid ester having an amino group, such as dimethylaminoethyl acrylate or diethylaminoethyl methacrylate. These acidic monomers and basic monomers may be used alone, or a plurality of them may be used as mixed. Otherwise, they may be present in the form of a salt with a counter ion. It is particularly preferred to employ an acidic monomer, and more preferred is acrylic acid and/or methacrylic acid.

The total amount of the acidic monomer and the basic monomer in 100 parts by mass of all polymerizable monomers constituting the binder resin is preferably at least 0.05 part by mass, more preferably at least 0.5 part by mass, further preferably at least 1.0 part by mass and preferably at most 10 parts by mass, more preferably at most 5 parts by mass.

Other polymerizable monomers may, for example, be a styrene such as styrene, methylstyrene, chlorostyrene, dichlorostyrene, p-tert-butylstyrene, p-n-butylstyrene or p-n-nonylstyrene, an acrylic acid ester such as methyl acrylate, ethyl acrylate, propyl acrylate, n-butyl acrylate, isobutyl acrylate, hydroxyethyl acrylate or 2-ethylhexyl acrylate, a methacrylic acid ester such as methyl methacrylate, ethyl methacrylate, propyl methacrylate, n-butyl methacrylate, isobutyl methacrylate, hydroxyethyl methacrylate or 2-ethylhexyl methacrylate, acrylamide, N-propylacrylamide, N,N-dimethylacrylamide, N,N-dipropylacrylamide, and N,N-dibutylacrylamide. Such polymerizable monomers may be used alone, or a plurality of them may be used in combination.

Further, in a case where the binder resin is made to be a crosslinkable resin, together with the above-described polymerizable monomers, a radical-polymerizable polyfunctional monomer is used, such as, divinylbenzene, hexanediol diacrylate, ethylene glycol methacrylate, diethylene glycol dimethacrylate, diethylene glycol diacrylate, triethylene glycol diacrylate, neopentyl glycol dimethacrylate, neopentyl glycol diacrylate or diallyl phthalate. Further, it is also possible to use a polymerizable monomer having a reactive group in a pendant group, such as glycidyl methacrylate, methylol acrylamide or acrolein. Among them, a radical-polymerizable bifunctional polymerizable monomer is preferred, and divinylbenzene or hexanediol diacrylate is particularly preferred. These polyfunctional polymerizable monomers may be used alone, or a plurality of them may be used as mixed.

In a case where a binder resin is prepared by emulsion polymerization, a known surfactant may be used as the emulsifier. As such a surfactant, one or more surfactants selected from a cationic surfactant, an anionic surfactant and a nonionic surfactant may be used.

The cationic surfactant may, for example, be dodecylammonium chloride, dodecylammonium bromide, dodecyltrimethylammonium bromide, dodecylpyridinium chloride, dodecylpyridinium bromide or hexadecyltrimethylammonium bromide, and the anionic surfactant may, for example, be a fatty acid soap such as sodium stearate or sodium dodecanoate, sodium dodecylsulfate, sodium dodecylbenzenesulfonate or sodium laurylsulfate. The nonionic surfactant may, for example, be polyoxyethylene dodecyl ether, polyoxyethylene hexadecyl ether, polyoxyethylene nonylphenyl ether, polyoxyethylene lauryl ether, polyoxyethylene sorbitan monooleate ether or monodecanoyl sucrose.

The amount of the emulsifier in the present invention is preferably at least 0.1 part by mass and at most 10 parts by mass, per 100 parts by mass of the polymerizable monomers. Further, together with such an emulsifier, one or more of polyvinyl alcohols such as partially or completely saponified polyvinyl alcohols, and cellulose derivatives such as hydroxyethylcellulose, may be used in combination as protective colloid.

The volume average particle diameter of primary particles of the polymer obtained by emulsion polymerization is usually at least 0.02 μm, preferably at least 0.05 μm, more preferably at least 0.1 μm, and usually at most 3 μm, preferably at most 2 μm, more preferably at most 1 μm. If the particle diameter is too small, control of the coagulation rate is likely to be difficult in the coagulation step, and if it is too large, the particle diameter of toner particles obtained by coagulation tends to be large, and it is likely to be difficult to obtain a toner having the desired particle diameter.

In the present invention, a known polymerization initiator may be used as the case requires, and as the polymerization initiator, one or a combination of two or more may be used. For example, a persulfate such as potassium persulfate, sodium persulfate or ammonium persulfate, and a redox initiator having such a persulfate as one component combined with a reducing agent such as acidic sodium sulfite; a water-soluble polymerization initiator such as hydrogen peroxide, 4,4'-azobiscyanovaleric acid, t-butyl hydroperoxide or cumene hydroperoxide, and a redox initiator having such a water-soluble polymerization initiator as one component combined with a reducing agent such as a ferrous salt; benzoyl peroxide, and 2,2'-azobisisobutyronitrile, may, for example, be used. Such a polymerization initiator may be added to the polymerization system at any time, i.e. before, during or after the addition of the monomer, and if necessary, these methods for addition may be used in combination.

In the present invention, a known chain transfer agent may be used as the case requires. Specific examples of such a chain transfer agent include t-dodecyl mercaptan, 2-mercaptoethanol, diisopropylxanthogen, carbon tetrachloride and trichlorobromomethane. Such chain transfer agents may be used alone or in combination as a mixture of two or more of them. Such a chain transfer agent may be used in an amount of from 0 to 5 mass % based on the polymerizable monomers.

In the present invention, a known suspension stabilizer may be used as the case requires. Specific examples of such a suspension stabilizer include potassium phosphate, magnesium phosphate, calcium hydroxide and magnesium hydroxide. They may be used alone or in combination as a mixture of two or more of them. The suspension stabilizer may be used in an amount of at least one part by mass and at most 10 parts by mass, per 100 parts by mass of the polymerizable monomers.

Each of the polymerization initiator and the suspension stabilizer may be added to the polymerization system at any time i.e. before, during or after the polymerizable monomers, and if necessary, these methods for addition may be used in combination.

Further, to the reaction system, a pH-controlling agent, a polymerization degree-controlling agent, a defoaming agent, etc. may suitably be added.

To the toner obtainable by the production method and apparatus of the present invention, it is preferred to incorporate wax to impart a release property. As such wax, any wax may be used so long as it has a release property.

Specifically, it may, for example, be an olefin wax such as a low molecular weight polyethylene, a low molecular weight polypropylene or a copolymer polyethylene; paraffin wax; an ester type wax having a long chain aliphatic group, such as behenyl behenate, a montanate or stearyl stearate; a vegetable wax such as hydrogenated castor oil carnauba wax; a ketone having a long chain alkyl group such as distearylketone; a silicone having an alkyl group; a higher fatty acid such as stearic acid; a long chain aliphatic alcohol such as eicosanol; a carboxylic acid ester or partial ester of a polybasic alcohol, obtainable from a polyhydric alcohol such as glycerol or pentaerythritol and a long chain fatty acid; a higher fatty acid amide such as oleic amide or stearic amide; or a low molecular weight polyester.

In order to improve the fixing property of such wax, the melting point of the wax is preferably at least 30° C., more preferably at least 40° C., particularly preferably at least 50° C. and preferably at most 100° C., more preferably at most 90° C., particularly preferably at most 80° C. If the melting point is too low, wax is likely to leach out on the surface after the fixing and tends to cause stickiness. On the other hand, if the melting point is too high, the fixing property at a low temperature tends to be poor.

Further, as a compound species of wax, a higher fatty acid ester wax is preferred. Specifically, the higher fatty acid ester wax may, for example, be preferably an ester of a $C_{15-30}$ fatty acid with a monohydric to pentahydric alcohol, such as behenyl behenate, stearyl stearate, a stearic acid ester of pentaerythritol, or montanic acid glyceride. Further, the alcohol component constituting the ester is preferably one having from 10 to 30 carbon atoms in the case of a monohydric alcohol, or one having from 3 to 10 carbon atoms in the case of a polyhydric alcohol.

The above waxes may be used along or in combination as a mixture. Further, depending upon the fixing temperature to fix the toner, the melting point of the wax compound may suitably be selected.

In the present invention, the amount of wax is preferably at least 1 part by mass, more preferably at least 2 parts by mass, further preferably at least 5 parts by mass, per 100 parts by mass of the toner. Further, it is preferably at most 40 parts by mass, more preferably at most 35 parts by mass, further preferably at most 30 parts by mass. If the wax content in the toner is too low, the performance such as the high temperature offset may not be sufficient, and if it is too high, the blocking resistance tends to be inadequate, or wax tends to leach out from the toner to soil the apparatus.

As the colorant of the present invention, a known colorant may optionally be used. Specific examples of the colorant include carbon black, aniline blue, phthalocyanine blue, phthalocyanine green, hansa yellow, rhodamine type dye or pigment, chromium yellow, quinacridone, benzidine yellow, rose bengal, a triallylmethane dye, a monoazo-, disazo-, or condensed azo-dye or pigment, etc. Such known optional dyes and pigments may be used alone or as mixed. In the case of a full color toner, as a yellow colorant, benzidine yellow, or a monoazo- or condensed azo-dye or pigment is preferably employed, as a magenta colorant, quinacridone, or a monoazo-dye or pigment is preferably employed, and as a cyan colorant, phthalocyanine blue is preferably employed. The colorant is preferably used in an amount of at least 3 parts by mass and at most 20 parts by mass, per 100 parts by mass of the polymer primary particles.

In the emulsion polymerization coagulation method, the colorant is incorporated usually in the coagulation step. A dispersion of polymer primary particles and a dispersion of colorant particles are mixed to obtain a mixed dispersion, which is coagulated to obtain agglomerates of particles. The colorant is preferably used in a state as dispersed in water in the presence of an emulsifier, and the volume average particle diameter of the colorant particles is preferably at least 0.01 μm, more preferably at least 0.05 μm and preferably at most 3 μm, more preferably at most 1 μm.

In the present invention, when an electrification-controlling agent is to be employed, known optional ones may be used alone or in combination. For example, a positively chargeable electrification-controlling agent may, for example, be a quaternary ammonium salt or a basic electron donative metal material, and a negatively chargeable electrification-controlling agent may, for example, be a metal chelate, a metal salt of an organic acid, a metal-containing dye, a nigrosine dye, an amide group-containing compound, a phenol compound, a naphthol compound or a metal salt thereof, a urethane bond-containing compound, or an acidic or electron attractive organic material.

Further, in a case where the toner for developing an electrostatic charge image obtainable by the production method of the present invention is used as a toner other than a black color toner in a color toner or full color toner, it is preferred to employ an electrification-controlling agent which is free from presenting a coloring trouble to a colorless or pale color toner. For example, as a positively chargeable electrification-controlling agent, a quaternary ammonium salt compound is preferred, and as a negative chargeable electrification-controlling agent, a metal salt or metal complex of salicylic acid or alkyl salicylic acid with e.g. chromium, zinc or aluminum, a metal salt or metal complex of benzylic acid, an amide compound, a phenol compound, a naphthol compound, a phenolamide compound or a hydroxynaphthalene compound such as 4,4'-methylenebis[2-[N-(4-chlorophenyl)amide]-3-hydroxynaphthalene] is preferred.

In the present invention, in a case where an electrification-controlling agent is to be incorporated to the toner by an emulsion polymerization coagulation method, the electrification-controlling agent may be added together with polymerizable monomers, etc. during the emulsion polymerization, or it may be added in the coagulation step together with the polymer primary particles, the colorant, etc., or it may be blended by a method of adding it after the polymer primary particles, the colorant, etc. are coagulated to have substantially the desired particle diameter. It is particularly preferred to disperse the electrification-controlling agent in water by means of a surfactant to obtain a dispersion with a volume average particle diameter of at least 0.01 μm and at most 3 μm, which is then added in the coagulation step.

In the emulsion polymerization coagulation method, coagulation is usually carried out in a tank provided with a stirring device, and it may be carried out by a heating method, a method of adding an electrolyte, or a combination of these methods. In a case where polymer primary particles are coagulated with stirring in order to obtain agglomerates of particles having a desired size, the size of agglomerates of particles is controlled by the balance between the coagulation force among particles and the shearing force by the stirring, and the coagulation force can be increased by heating or by adding an electrolyte.

In a case where coagulation is carried out by adding an electrolyte in the present invention, such an electrolyte may be an organic salt or an inorganic salt. Specifically, it may, for example, be NaCl, KCl, LiCl, $Na_2SO_4$, $K_2SO_4$, $Li_2SO_4$, $MgCl_2$, $CaCl_2$, $MgSO_4$, $CaSO_4$, $ZnSO_4$, $Al_2(SO_4)_3$, $Fe_2(SO_4)_3$, $CH_3COONa$ or $C_6H_5SO_3Na$. Among them, an inorganic salt having a bivalent or higher valent metal cation is preferred.

In the present invention, the amount of the electrolyte varies depending upon the type of the electrolyte, the desired particle diameter, etc., but it is preferably at least 0.05 part by mass, more preferably at least 0.1 part by mass, per 100 parts by mass of the solid component of the mixed dispersion. Further, it is preferably at most 25 parts by mass, more preferably at most 15 parts by mass, particularly preferably at most 10 parts by mass. If the amount is too small, the progress of the coagulation reaction tends to be slow, whereby there may be a problem such that a fine powder of 1 μm or less remains after the coagulation reaction, or the average particle diameter of agglomerates of particles thereby obtained does not reach the desired particle diameter. On the other hand, if it is too large, the coagulation tends to be rapid, whereby there may be a problem such that control of the particle diameter becomes difficult, or coarse particles or irregular particles tend to be contained in the obtained coagulated particles. The coagulation temperature in the case of carrying out the coagulation by adding an electrolyte, is preferably at least 20° C., more preferably at least 30° C. and preferably at most 70° C. or more preferably at most 60° C.

In a case where the coagulation is carried out only by heating without using an electrolyte, the coagulation temperature is preferably at least (Tg-20)° C., more preferably at least (Tg-10)° C., where Tg is the glass transition temperature of the polymer primary particles. Further, it is preferably at most Tg, more preferably at most (Tg-5)° C.

The time required for the coagulation is optimized by the shape of the apparatus or the treatment scale. However, in order to bring the particle diameter of the toner to the desired particle diameter, it is usually preferred to maintain the system at the above prescribed temperature for at least 30 minutes. The temperature may be raised to the prescribed temperature at a constant rate or stepwise.

To the surface of agglomerates of particles after the above coagulation treatment, resin particles may be attached or fixed, as the case requires. By attaching or fixing resin particles having the properties controlled, to the surface of agglomerates of particles, it may be possible to improve the electrostatic property or the thermal resistance of the obtainable toner and further to increase the effects of the present invention.

It is preferred to employ, as the resin particles, ones having a glass transition temperature higher than the glass transition temperature of the polymer primary particles, whereby it is possible to realize a further improvement of the blocking resistance without impairing the fixing property. The volume average particle diameter of the resin particles is preferably at least 0.02 μm, more preferably at least 0.05 μm and preferably at most 3 μm, more preferably at most 1.5 μm. As such resin particles, it is possible to employ ones obtainable by emulsion polymerization of the same monomer as the polymerizable monomer to be used for the above-described polymer primary particles.

The resin particles are usually employed in the form of a dispersion as dispersed in water or a liquid containing water as the main component, by means of a surfactant. In a case where an electrification-controlling agent is added after the coagulation treatment, it is preferred to add the resin particles after adding the electrification-controlling agent to the dispersion containing agglomerates of particles.

In order to increase the stability of the agglomerates of particles obtained in the coagulation step, it is preferred to carry out fusion among agglomerated particles in an aging step after the coagulation step. The temperature in the aging step is preferably at least Tg of the polymer primary particles, more preferably at least a temperature higher by 5° C. than Tg and preferably at most a temperature higher by 80° C. than Tg, more preferably at most a temperature higher by 50° C. than Tg. Further, the time required for the aging step varies depending upon the desired shape of the toner, but it is usually from 0.1 to 10 hours, preferably from 1 to 6 hours, after the temperature has reached at least the glass transition temperature of the polymer primary particles.

Further, after the coagulation step, preferably before the aging step or during the aging step, it is preferred to add a surfactant or to increase the pH value. As the surfactant to be used here, at least one member may be selected for use from emulsifiers which may be used at the time of producing the polymer primary particles, but it is particularly preferred to employ the same emulsifier as the one used for the production of the polymer primary particles. In the case of adding the surfactant, the amount is not particularly limited but is preferably at least 0.1 part by mass, more preferably at least 1 part by mass, further preferably at least 3 parts by mass and preferably at most 20 parts by mass, more preferably at most 15 parts by mass, more preferably at most 10 parts by mass, per 100 parts by mass of the solid component in the mixed dispersion. By adding the surfactant or increasing the pH value after the coagulation step and before completion of the aging step, it may be possible to suppress e.g. aggregation of agglomerates of particles coagulated in the coagulation step and to suppress formation of coarse particles after the aging step.

By heat treatment in the aging step, fusion and integration among polymer primary particles are carried out in the agglomerates, whereby the shape of the toner particles as the agglomerates becomes close to a spherical shape. Agglomerates of particles before the aging step are considered to be coagulated by electrostatic or physical coagulation of polymer primary particles, but after the aging step, polymer primary particles constituting the agglomerates of particles are considered to be mutually fused, and the shape of the toner particles can be made to be close to a spherical shape. By such an aging step, by controlling the temperature, time, etc. of the aging step, it is possible to produce a toner having various shapes depending upon the particular purpose, such as a shape having polymer primary particles agglomerated, or spherical shape having the fusion further advanced.

The obtained particles are subjected to solid-liquid separation by a known method to recover the particles, which are, as the case requires, washed and dried to obtain the desired toner matrix particles.

The toner of the present invention is required to contain two types of particles i.e. silica particles satisfying at least the following (1) to (3) and particles having an electrostatic property antipolar to the silica particles, but within a range not to impair the effects of the present invention, such particles may be attached or fixed to the surface of toner matrix particles as combined with "other particles" known as additives:

(1) the average primary particle diameter is at least 60 nm and at most 300 nm, (2) the moisture content is at most 4-1.0 mass %, and (3) the absolute specific gravity is at least 2.0 and at most 2.4.

As "other particles", inorganic particles of e.g. silica, aluminum oxide (alumina), zinc oxide, tin oxide, barium titanate or strontium titanate; organic salt particles of e.g. zinc stearate or calcium stearate; and organic resin particles such as methacrylate polymer particles, acrylate polymer particles, styrene/methacrylate copolymer particles or styrene/acrylate copolymer particles, may, for example, be mentioned.

The blend proportions of the silica particles of the present invention, the particles having an electrostatic property antipolar to the silica particles, and "other particles", are not particularly limited, and the amounts of the silica particles, the particles having an electrostatic property antipolar to the silica particles, and all additives made of "other particles" are also not particularly limited. However, the amount of all additives is preferably at least 1 part by mass, more preferably at least 1.5 parts by mass, particularly preferably at least 2 parts by mass and preferably at most 5 parts by mass, more preferably at most 4 parts by mass, per 100 parts by mass of the toner matrix particles. If the amount is too small, the flowability may deteriorate, or it may become difficult to control the electrostatic charge. On the other hand, if it is too large, free additives not attached are likely to soil components in the cartridge and may cause an image defect.

With respect to the silica particles and the particles having an electrostatic property antipolar to the silica particles to be used in the present invention, the order to attach or fix them to the surface of the toner matrix particles is not particularly limited. However, from the viewpoint of the functional mechanism of the present invention, the silica particles are preferably added at the same time as or before other additives to be used in combination, and the particles having an electrostatic property antipolar to the silica particles are preferably added at the same time as or after other additives to be used in combination.

In the present invention, the method for attaching or fixing the above melamine resin particles and "other particles" to the surface of the toner matrix particles is not particularly limited, and it is possible to use a mixing machine which is commonly used for the production of a toner. Specifically, it can be carried out by uniformly stirring and mixing them by a mixing machine such as a Henschel mixer, a V-type blender, a Loedige mixer or Q-mixer.

The volume median diameter of the toner of the present invention is preferably at least 4 μm, more preferably at least 5 μm and preferably at most 8 μm, more preferably at most 7 μm. If the volume median diameter is too large, the electrostatic charge per unit weight tends to be small, and fogging is likely to result. On the other hand, if it is too small, the adhesive force of the toner tends to be too large, whereby the flowability may deteriorate, thus leading to image blurring or the like. The volume median diameter is measured by the method disclosed in Examples.

The average circularity of the toner of the present invention is preferably at least 0.955, more preferably at least 0.960 and preferably at most 0.985, more preferably at most 0.980. If the average circularity is too high, scraping through the cleaning section is likely to occur thus leading to an image defect, and if it is too low, the particles on the surface may fall into concaves of the matrix particles by stirring for printing, whereby the expected effects cannot be obtained, and an image defect in printing such as fogging is likely to result. The circularity of the toner matrix particles of the present invention is measured by the method disclosed in Examples.

The toner of the present invention is useful for all kinds of electrophotographic printers, copy machines, etc. irrespective of the development system. However, when it is used in a nonmagnetic one component development method which is regarded as being strict with respect to the electrostatic property, its effects will be more distinct, such being preferred. Further, it is preferred that the process speed of the machine is faster whereby further effects may be obtainable. Specifically, it is preferably at least 100 mm/sec, more preferably at least 120 mm/sec, particularly preferably at least 150 mm/sec.

EXAMPLES

Now, the present invention will be described in further detail with reference to Examples, but it should be understood that the present invention is by no means limited to the following Examples. In the following Examples, "parts" means "parts by mass", and "%" means "mass %".

<Method for Measuring Average Particle Diameter of Polymer Primary Particles>

Using Model: Microtrac Nanotrac 150 (hereinafter referred to simply as "Nanotrac") manufactured by Nikkiso Co., Ltd., in accordance with the handling manual of Nanotrac, the average particle diameter was measured by the method described in the handling manual by using the analysis soft Microtrac Particle Analyzer Ver 10.1.2.-019EE and using, as a dispersing medium, ion-exchanged water having an electric conductivity of 0.5 μS/cm under the following conditions or inputting the following conditions:

Refractive index of solvent: 1.333
Measuring time: 100 seconds
Number of measuring times: Once
Refractive index of particles: 1.59
Permeability: Permeable
Shape: Spherical shape
Density: 1.04

<Method for Measuring Volume Median Diameter (Dv) and Number Median Diameter (Dn) of Toner Particles>

Measured by means of Multisizer III (aperture diameter: 100 μm) (hereinafter referred to simply as "Multisizer") manufactured by Beckman Coulter, Inc. by using as a dispersion medium Isoton II manufactured by the same company and dispersing the toner particles so that the dispersoid concentration became 0.03 mass %. The range of particle diameters to be measured was set to be from 2.00 to 64.00 μm, and this range was made discrete into 256 divisions with equal distances by a logarithmic scale, whereby one calculated on the basis of their volume-based statistical values was taken as a volume median diameter (Dv), and one calculated on the basis of their number-based statistical values was taken as a number median diameter (Dn).

<Method for Measuring Average Circularity of Toner Particles>

The average circularity was measured by dispersing a dispersoid in a dispersion medium (Cellseath, manufactured by Sysmex) so that its concentration became from 5,720 to 7,140 particles/μl and by using a flow-type particle image analyzer (FPIA3000, manufactured by Sysmex) by a HPF mode under such conditions that the HPF analytical amount was 0.35 μl and the HPF detection amount was from 2,000 to 2,500 particles. A value of the average circularity is automatically calculated and shown in the analyzer by the above measurement.

<Method for Measuring Average Primary Particle Diameter>

The "average primary particle diameter" of particles present on the surface of a toner was measured by carrying out an image analysis of a SEM photograph. Specifically, a suitable number of sheets of photograph of particles magnified 30,000 times were taken by means of scanning electron microscope S4500 manufactured by Hitachi, Ltd., then, 100 particles were randomly selected, and their circle equivalent diameters were measured by an image analysis software WinROOF manufactured by Mitani Corporation, whereupon their average value was taken as an "average primary particle diameter".

<Method for Measuring Moisture Content>

The moisture content was measured by means of a coulometric titration-type moisture-measuring apparatus VA-100 or CA-100 manufactured by Mitsubishi Chemical Analytech Co., Ltd. and using Aquamicron AX for a generation liquid tank and Aquamicron CXU for a counter electrode liquid tank. (Carrier gas: $N_2$ 250 ml/min)

1.0 g of a sample was weighed on a charta and put into a glass container for a sample. The glass container was inserted in a heater of the apparatus and heated at 150° C. for 30 minutes, and the gas phase was introduced into the liquid tank to measure the moisture content.

<Method for Measuring Absolute Specific Gravity>

Using a Le Chatelier's specific gravity bottle, the absolute specific gravity was measured in accordance with JIS K-0061 5-2-1. The operation was carried out as follows.

(1) Into a Le Chatelier's specific gravity bottle, about 250 ml of ethyl alcohol is put and adjusted so that the meniscus is located at the scale mark position.

(2) The specific gravity bottle is immersed in a constant temperature water tank, and when the liquid temperature becomes 20.0±0.2° C., the position of the meniscus is accurately read out by the scale marks of the specific gravity bottle. (Precision: 0.025 ml)

(3) About 100 g of a sample is weighed, and its mass is designated as W.

(4) The weighed sample is put into the specific gravity bottle, and bubbles are removed.

(5) The specific gravity bottle is immersed in a constant temperature water tank, and when the liquid temperature becomes 20.0±0.2° C., the position of the meniscus is accurately read out by scale marks of the specific gravity bottle. (Precision: 0.025 ml)

(6) The absolute specific gravity is calculated by the following formulae.

$$D=W/(L2-L1)$$

$$S=D/0.9982$$

In the formulae, D is the density (20° C.) (g/cm$^3$) of the sample, S is the absolute specific gravity (20° C.) of the sample, W is the apparent mass (g) of the sample, L1 is the read out value (20° C.) (ml) of the meniscus before the sample is put into the specific gravity bottle, L2 is the read out value (20° C.) (ml) of the meniscus after the sample is put into the specific gravity bottle, and 0.9982 is the density (g/cm$^3$) of water at 20° C.

<Method of Measuring Electrostatic Polarity and Electrostatic Charge of Particles>

In an environment at a temperature of 23° C. under a relative humidity of 55%, 19.8 g of a carrier: F-150 core (manufactured by Powdertech) and 0.2 g of a sample were put into a 20 ml glass bottle and left to stand for at least 12 hours. Thereafter, they were mixed by hand shaking for 50 reciprocations, followed by stirring with an amplitude of 1.0 cm at a shaking speed of 500 rpm for 1 minute.

From the glass bottle, 0.2 g was taken out and measured by means of Blowoff TB-200 apparatus manufactured by Toshiba Chemical under the following conditions:

$N_2$ pressure meter: 1.0 kg/cm$^2$
SET TIME: 20.0 sec.
Metal net set at Faraday gauge (made of stainless steel: 400 mesh)

With respect to the read out value Q (μC), calculation is made by the following equation to obtain the electrostatic charge per unit weight Q/M (μC/g), and it is possible to judge whether the sample is positively chargeable or negatively chargeable.

$$Q/M(\mu C/g)=-(Q(\mu C)/(\text{measured mass(g)}))\times 100$$

[Production of Matrix Particles A]

<Preparation of Wax/Long Chain Polymerizable Monomer Dispersion A1>

27 Parts of paraffin wax (HNP-9, manufactured Nippon Seiro Co., Ltd.), 2.8 parts of stearyl acrylate (manufactured by Tokyo Chemical Industry Co., Ltd.), 1.9 parts of a 20% sodium dodecylbenzenesulfonate aqueous solution (Neogen S20D, manufactured by Dai-ichi Kogyo Seiyaku Co., Ltd.) (hereinafter referred to simply as the "20% DBS aqueous solution") and 68.3 parts of deionized water were heated to 90° C. and stirred for 10 minutes by a homomixer (Mark IIf model, manufactured by Tokushu Kika Kogyo). Then, this dispersion was heated to 90° C., and by means of a homogenizer (15-M-8PA model, manufactured by Gaulin), circulation emulsification was initiated under a pressure condition of 25 MPa, and while measuring the particle diameter by Nanotrac, it was dispersed until the volume average particle diameter (MV) became 250 nm, to prepare a wax/long chain polymerizable monomer dispersion A1 (solid content concentration of emulsion=30.2%).

<Preparation of Silicone Wax Dispersion A2>

27 Parts of an alkyl-modified silicone wax (melting point: 77° C.), 1.9 parts of the 20% DBS aqueous solution and 71.1 parts of deionized water were put into a stainless steel container, heated to 90° C. and stirred by a homomixer (Mark IIf model, manufactured by Tokushu Kika Kogyo) for 10 minutes. Then, this dispersion was heated to 99° C., and by means of a homogenizer (15-M-8PA model, manufactured by Gaulin), circulation emulsification was initiated under a pressure condition of 45 MPa, and while measuring the particle diameter by Nanotrac, it was dispersed until the volume average particle diameter (MV) became 240 nm, to prepare a silicone wax dispersion A2 (solid content concentration of emulsion=27.4%).

<Preparation of Polymer Primary Particle Dispersion A1>

Into a reactor equipped with a stirring device (three vanes), a heating/cooling device, a concentrating device and a device for charging various raw materials and additives, 35.6 parts of the wax/long chain polymerizable monomer dispersion A1 and 259 parts of deionized water were charged and heated to 90° C. in a nitrogen stream with stirring.

Thereafter, while stirring was continued, a mixture of the following monomers and aqueous emulsifier solution was added over a period of 5 hours from the initiation of the polymerization. The time when addition of the mixture of monomers and aqueous emulsifier solution was started, was taken as the initiation of the polymerization, and after 30 minutes from the initiation of the polymerization, the following aqueous initiator solution was added over a period of 4.5 hours, and further, after 5 hours from the initiation of the polymerization, the following aqueous additional initiator solution was added over a period of 2 hours, and the polymerization system was maintained for further 1 hour at an internal temperature of 90° C. while stirring was continued.

[Monomers]

| | |
|---|---|
| Styrene | 76.8 parts |
| Butyl acrylate | 23.2 parts |
| Acrylic acid | 1.5 parts |
| Trichlorobromomethane | 1.0 part |
| Hexanediol diacrylate | 0.7 part |

[Aqueous Emulsifier Solution]

| | |
|---|---|
| 20% DBS aqueous solution | 1.0 part |
| Deionized water | 67.1 parts |

[Aqueous Initiator Solution]

| | |
|---|---|
| 8% Hydrogen peroxide aqueous solution | 15.5 parts |
| 8% L(+)-ascorbic acid aqueous solution | 15.5 parts |

[Aqueous Additional Initiator Solution]

| | |
|---|---|
| 8% L(+)-ascorbic acid aqueous solution | 14.2 parts |

After completion of the polymerization reaction, the reaction system was cooled to obtain a milky white polymer primary particle dispersion A1. This dispersion was measured by means of Nanotrac, whereby the volume average particle diameter (MV) was 280 nm, and the solid content concentration was 21.1%.

<Preparation of Polymer Primary Particle Dispersion A2>

Into a reactor equipped with a stirring device (three vanes), a heating/cooling device, a concentrating device and a device for charging various raw materials and additives, 23.6 parts of a silicone wax dispersion A2, 1.5 parts of the 20% DBS aqueous solution and 324 parts of deionized water were charged and heated to 90° C. in a nitrogen stream, and 3.2 parts of a 8% hydrogen peroxide aqueous solution and 3.2 parts of a 8% L(±)-ascorbic acid aqueous solution were added all at once with stirring.

5 Minutes later, a mixture of the following monomers and aqueous emulsifier solution was added over a period of 5 hours from the initiation of the polymerization (after 5 minutes from the time when 3.2 parts of the 8% hydrogen peroxide aqueous solution and 3.2 parts of the 8% L(+)-ascorbic acid aqueous solution were added all at once), the following initiator aqueous solution was added over a period of 6 hours from the initiation of the polymerization, and the polymerization system was maintained for further 1 hour at an internal temperature of 90° C. while stirring was continued.

[Monomers]

| | |
|---|---|
| Styrene | 92.5 parts |
| Butyl acrylate | 7.5 parts |
| Acrylic acid | 1.5 parts |
| Trichlorobromomethane | 0.6 part |

[Aqueous Emulsifier Solution]

| | |
|---|---|
| 20% DBS aqueous solution | 1.5 parts |
| Deionized water | 66.2 parts |

[Aqueous Initiator Solution]

| | |
|---|---|
| 8% Hydrogen peroxide aqueous solution | 18.9 parts |
| 8% L(+)-ascorbic acid aqueous solution | 18.9 parts |

After completion of the polymerization reaction, the reaction system was cooled to obtain a milky white polymer primary particle dispersion A2. This dispersion was measured by means of Nanotrac, whereby the volume average particle diameter (MV) was 290 nm, and the solid content concentration was 19.0 mass %.

<Preparation of Colorant Dispersion A>

Into a container equipped with a stirrer (propeller vanes), 20 parts of carbon black (Mitsubishi Carbon Black MA100S, manufactured by Mitsubishi Chemical Corporation), 1 part of the 20% DBS aqueous solution, 4 parts of a nonionic surfactant (Emulgen 120, manufactured by Kao Corporation) and 75 parts of ion-exchanged water having an electric conductivity of 2 μS/cm were added and preliminarily dispersed to obtain a premix liquid. The volume average diameter (Mv) of carbon black in the above premix liquid was 90 μm.

The above premix liquid was supplied to a wet-system beads mill and subjected to one-pass dispersion. While setting the rotational speed of a rotor to be constant, the above premix slurry was continuously supplied from an inlet at a constant supply rate by a nonpulsatile metering pump and continuously discharged from an outlet to obtain a black colored colorant dispersion A. The volume average diameter (Mv) of the colorant in the colorant dispersion was 150 nm.

<Production of Matrix Particles A>

| | |
|---|---|
| Polymer primary particle dispersion A1 | 95 parts as solid content |
| Polymer primary particle dispersion A2 | 5 parts as solid content |
| Colorant fine particle dispersion A | 6 parts as colorant solid content |
| 20% DBS aqueous solution | 0.1 part as solid content |

Using the above respective components, matrix particles were produced by the following procedure.

Into a mixer equipped with a stirring device (double helical vanes), a heating/cooling device, a concentrating device and a device for charging various raw materials and additives, the polymer primary particle dispersion A1 and the 20% DBS aqueous solution were charged and uniformly mixed at an internal temperature of 12° C. for 5 minutes. Then, while stirring was continued at an internal temperature of 12° C., an aqueous solution containing 5% of ferrous sulfate was added in an amount of 0.52 part as $FeSO_4.7H_2O$ over a period of 5 minutes, and then the colorant fine particle dispersion A was added over a period of 5 minutes, followed by uniform mixing at an internal temperature of 12° C. Further, under the same conditions, a 0.5% aluminum sulfate aqueous solution was dropwise added (the solid content to the resin solid content: 0.10 part). Thereafter, the internal temperature was raised to 53° C. over a period of 75 minutes and further raised to 56° C. over a period of 90 minutes. Here, the volume median diameter was measured by means of Multisizer and was found to be 5.2 μm. Thereafter, the polymer primary particle dispersion A2 was added over a period of 3 minutes and then held for 60 minutes as it was. Then, the 20% DBS aqueous solution (6 parts as the solid content) was added over a period of 10 minutes, and then the temperature was raised to 90° C. over a period of 30 minutes and held for 75 minutes.

Thereafter, the system was cooled to 30° C. over a period of 20 minutes, and the obtained slurry was withdrawn and subjected to suction filtration by means of an aspirator using a filter paper of No. 5C (No. 5C, manufactured by Toyo Roshi). A cake remained on the filter paper was transferred to a stainless steel container equipped with a stirrer (propeller vanes) and ion-exchanged water having an electrical conductivity of 1 μS/cm was added, followed by stirring for uniform dispersion. Thereafter, the stirring was continued for 30 minutes.

Thereafter, suction filtration was again carried out by means of an aspirator using a filter paper of No. 5C (No. 5C, manufactured by Toyo Roshi), and the solid remained on the filter paper was again transferred to a container containing ion-exchanged water having an electrical conductivity of 1 μS/cm and equipped with a stirrer (propeller vanes) and stirred for uniform dispersion, and the stirring was continued for 30 minutes. This process was repeated five times, whereupon the electrical conductivity of the filtrate became 2 μS/cm.

The cake thus obtained was spread on a stainless steel pad so that the height became 20 mm and dried for 48 hours in an air-circulating dryer set at 40° C. to obtain matrix particles A. The volume median diameter of the obtained toner matrix particles A was 5.7 μm, and the average circularity was 0.972.

In Examples and Comparative Examples, the following silica particles A to F were used.

Silica particles A: The original material is prepared by a dry method, and its surface is treated with polydimethylsiloxane. (Average primary particle diameter: 85 nm, moisture content: 0.11%, absolute specific gravity: 2.2, negatively chargeable)

Silica particles B: The original material is prepared by a dry method, and its surface is treated with hexamethyldisilazane. (Average primary particle diameter: 80 nm, moisture content: 0.12%, absolute specific gravity: 2.2, negatively chargeable)

Silica particles C: The original material is prepared by a wet method, and its surface is treated with hexamethyldisilazane. (Average primary particle diameter: 110 nm, moisture content: 2.82%, absolute specific gravity: 1.8, negatively chargeable)

Silica particles D: The original material is prepared by a wet method, and its surface is treated with hexamethyldisilazane. (Average primary particle diameter: 115 nm, moisture content: 2.02%, absolute specific gravity: 2.2, negatively chargeable)

Silica particles E: The original material is prepared by a wet method, and its surface is treated with hexamethyldisilazane. (Average primary particle diameter: 85 nm, moisture content: 2.43%, absolute specific gravity: 2.2, negatively chargeable)

Silica particles F: The original material is prepared by a dry method, and its surface is treated with polydimethylsiloxane. (Average primary particle diameter: 50 nm, moisture content: 0.22%, absolute specific gravity: 2.2, negatively chargeable)

Example 1

Production of Toner A

To the matrix particles A (100 parts), 2 parts of the above silica particles A, further 1 part of the dry silica particles having a volume average particle diameter of 8 nm treated with polydimethylsiloxane and 0.2 part of melamine resin particles (positively chargeable) having a volume average particle diameter of 200 nm, were added, followed by mixing by a Henschel mixer at a circumferential speed of 45.8 m/sec for 20 minutes, whereupon removal of coarse particles was carried out by a sieve having an aperture of 75 μm to obtain a toner A.

Example 2

Production of Toner B

A toner B was obtained in the same manner as in Example 1 except that in Example 1, silica particles B were used instead of silica particles A.

Example 3

Production of Toner C

A toner C was obtained in the same manner as in Example 1 except that in Example 1, acrylic resin particles (positively chargeable) were used instead of the melamine resin particles.

Comparative Example 1

Production of Toner D

A toner D was obtained in the same manner as in Example 1 except that in Example 1, silica particles C were used instead of silica particles A.

Comparative Example 2

Production of Toner E

A toner E was obtained in the same manner as in Example 1 except that in Example 1, silica particles D were used instead of silica particles A.

Comparative Example 3

Production of Toner F

A toner F was obtained in the same manner as in Example 1 except that in Example 1, silica particles E were used instead of silica particles A.

Comparative Example 4

Production of Toner G

A toner G was obtained in the same manner as in Example 1 except that in Example 1, silica particles F were used instead of silica particles A.

Comparative Example 5

Production of Toner H

A toner H was obtained in the same manner as in Example 1 except that in Example 1, no melamine resin particles were used.

Comparative Example 6

Production of Toner I

A toner I was obtained in the same manner as in Example 1 except that in Example 1, no silica particles A were used.

<Evaluation Method>

For evaluation of the obtained toners, the image evaluation was carried out by an actual printing test.

For the actual printing, a 600 dpi full color printer was employed by using a nonmagnetic one component and an organic photoreceptor (OPC) by a roller (PCR) electrification, a rubber developing roller-contact development system at a development rate of 164 mm/sec, a tandem system, a belt transportation system, a direct transfer system and a blade drum cleaning system, with a guaranteed number of copies for operating life at a 5% printing ratio being 30,000 copies.

<Method for Evaluating Soiling of Components>

After carrying out printing of a few copies in an environment at 25° C. under a humidity of 50%, OPC and PCR were visually observed, and soiling of components by peeled additives was ascertained. Further, a 1% printing ratio chart was printed up to 10,000 copies by intermittent operation of 3 copies, whereby the observation was made in the same manner to judge soiling of components at the initial stage of the operation life and after the printing. The evaluation standards were as follows.

○: From the initial stage to after the printing, good without soiling

○Δ: Although soiling is observed to some extent after the printing, good without any practical problem.

x: No good, since soiling is distinctly observed from the initial stage and is practically problematic.

<Method for Evaluating OPC Filming

After the above-mentioned printing up to 10,000 copies, a solid image was printed, and the presence or absence of an image defect caused by OPC filming, such as white spots appearing on an OPC cycle along the process direction, was ascertained by visual observation. The evaluation standards were as follows.

○: Good as no image defect is observed.

x: No good as an image defect is observed.

<Method for Evaluating Fogging>

After the above printing up to 10,000 copies, the printer was left to stand for 15 hours in an environment at 35° C. under a humidity of 85%, and then, printing was carried out. At that time, before the transfer step to paper, the toner attached to a background portion in OPC was transferred by a mending tape (manufactured by Sumitomo 3M), which was bonded on printing paper of 80 g/m$^2$. Further, for comparison, the mending tape was, as it was, bonded on the same paper, whereupon the color difference ΔE between the two was measured by a spectrocalorimetric densitometer X-Rite 939 (manufactured by X-Rite) to evaluate fogging. The evaluation standards were as follows.

○: ΔE being less than 4.

Δ: ΔE being at least 4 and less than 10.

x: ΔE being at least 10.

The results were as follows.

TABLE 1

| | | Silica particles | Antipolar particles | Soiling of components | OPC filming | Fogging |
|---|---|---|---|---|---|---|
| Ex. 1 | Toner A | Silica A | Melamine resin particles | ○ | ○ | ○ |
| Ex. 2 | Toner B | Silica B | Melamine resin particles | ○Δ | ○ | ○ |
| Ex. 3 | Toner C | Silica A | Acrylic resin particles | ○ | ○ | Δ |
| Comp. Ex. 1 | Toner D | Silica C | Melamine resin particles | X | ○ | ○ |
| Comp. Ex. 2 | Toner E | Silica D | Melamine resin particles | X | ○ | Δ |
| Comp. Ex. 3 | Toner F | Silica E | Melamine resin particles | X | ○ | Δ |
| Comp. Ex. 4 | Toner G | Silica F | Melamine resin particles | ○ | X | ○ |
| Comp. Ex. 5 | Toner H | Silica A | Nil | ○ | ○ | X |
| Comp. Ex. 6 | Toner I | Nil | Melamine resin particles | ○ | X | ○ |

The entire disclosure of Japanese Patent Application No. 2010-120683 filed on May 26, 2010 including specification, claims and summary is incorporated herein by reference in its entirety.

What is claimed is:

1. A toner for developing an electrostatic charge image, comprising:

a binder resin;

a colorant;

silica particles satisfying:

(1) an average primary particle diameter of from 60 nm to 300 nm, (2) a moisture content of less than 0.5 mass %, and (3) an absolute specific gravity of from 2.0 to 2.4; and particles having an electrostatic property antipolar to the silica particles.

2. The toner for developing an electrostatic charge image according to claim 1, wherein the silica particles are prepared by a dry method.

3. The toner for developing an electrostatic charge image according to claim 1, wherein the particles having an electrostatic property antipolar to the silica particles are melamine resin particles, acrylic resin particles or silica particles.

4. The toner for developing an electrostatic charge image according to claim 1, wherein the silica particles have their surface subjected to hydrophobic treatment.

5. The toner for developing an electrostatic charge image according to claim 1, wherein the particles having an electrostatic property antipolar to the silica particles have an average primary particle diameter of at least 80 nm and at most 300 nm.

6. The toner for developing an electrostatic charge image according to claim 1, wherein the silica particles and the particles having an electrostatic property antipolar to the silica particles, are attached or fixed to the surface of toner matrix particles.

7. The toner for developing an electrostatic charge image according to claim 1, wherein the toner further contains wax.

8. The toner for developing an electrostatic charge image according to claim 1, wherein the toner is produced by a pulverization method or a wet method.

9. The toner for developing an electrostatic charge image according to claim 1, wherein the toner has a volume median diameter of from 4 to 8 μm and an average circularity of from 0.955 to 0.985.

10. An image-forming method by means of an electrophotographic method provided at least with a photoreceptor, a toner, an electrification device and a transfer device, characterized in that the toner for developing an electrostatic charge image as defined in claim 1 is used for a non-magnetic one-component development method.

11. The image-forming method according to claim 10, wherein the development rate is at least 100 mm/sec.

12. The toner for developing an electrostatic charge image according to claim 1, wherein the moisture content of the silica particles is 0.12 mass % or less.

* * * * *